US009008342B1

(12) United States Patent
Hagman

(10) Patent No.: US 9,008,342 B1
(45) Date of Patent: Apr. 14, 2015

(54) WATERPROOF SPEAKER SYSTEM

(76) Inventor: Paul N. Hagman, Mount Vernon, WA (US)

( * ) Notice: Subject to any disclaimer, the term of this patent is extended or adjusted under 35 U.S.C. 154(b) by 296 days.

(21) Appl. No.: 13/603,196

(22) Filed: Sep. 4, 2012

(51) Int. Cl.
*H04R 1/02* (2006.01)

(52) U.S. Cl.
CPC ..... *H04R 1/02* (2013.01)

(58) Field of Classification Search
CPC ..... H04R 1/44
USPC ..... 181/149; 381/334; 367/165, 173, 188
See application file for complete search history.

(56) References Cited

U.S. PATENT DOCUMENTS 4,926,398 A * 5/1990 Fincher ..... 367/172
5,136,549 A * 8/1992 Berglund ..... 367/20
6,396,769 B1 * 5/2002 Polany ..... 367/131
7,292,702 B2 * 11/2007 Hagman ..... 381/345
2005/0067216 A1 * 3/2005 Schuhmann et al. ..... 181/149
2012/0134518 A1 * 5/2012 Otani et al. ..... 381/189

FOREIGN PATENT DOCUMENTS

FR 2907069 A3 * 4/2008 ..... B60R 25/00

* cited by examiner

*Primary Examiner* — Wayne Young
*Assistant Examiner* — Mark Fischer
(74) *Attorney, Agent, or Firm* — Dwayne E. Rogge; Schacht Law Office, Inc.

(57) ABSTRACT

Disclosed herein is a waterproof speaker system for use in residential and commercial applications. The disclosed speaker system is particularly applicable to wet conditions such as greenhouses, gardens, boats, and other outdoor installations or where traditional speakers are negatively affected by water and humidity. The waterproof speaker system generally comprises a solid water impermeable cast rear and side casing, and internal front frame member housing the speaker drivers and in some cases a simple electronics or amplification circuit, and a water impermeable front face panel sealed to the front frame member and/or the rear casing to completely enclose the speaker driver from contact with moisture.

9 Claims, 7 Drawing Sheets

WATERPROOF SPEAKER SYSTEM

BACKGROUND OF THE DISCLOSURE

Field of the Disclosure

This disclosure relates to the field of waterproof speaker enclosures and systems. In particular, the disclosure relates to a speaker system using an acoustic lever model of resonance.

SUMMARY OF THE DISCLOSURE

A waterproof speaker system is disclosed herein comprising in one example a water impermeable rear casing cast as a unitary body with a rear panel, and side panels substantially orthogonal to the rear panels. A front frame cast as a unitary body and having a perimeter edge is sealed to an interior surface of the side panels of the rear casing. In this example a water impermeable front face panel is sealed to a perimeter face of the front frame and the front frame has a surface defining a driver void therethrough having substantially the same shape as the perimeter edge of a low frequency speaker driver. The perimeter edge of the low frequency speaker driver is attached to the surface defining the driver void such that the low frequency speaker driver is not in contact with the front face panel. A rear surface of the front face panel, front surface of the front frame, front surface of the low frequency speaker driver and offset edge define an offset void allowing the front face panel to oscillate without contacting the front face frame nor low frequency speaker driver. A speaker wiring stud is sealed to and projects through the casing to provide electrical communication to the low frequency speaker driver.

The waterproof speaker system as recited herein may further comprise a resilient member compressed between a rear surface of the low frequency speaker driver and a front facing surface of the rear casing.

The waterproof speaker system as recited herein may be arranged wherein the resilient member is adhered to one or both of the rear surface of the low frequency speaker driver and front facing surface of the rear casing.

The waterproof speaker system as recited herein may further comprise a compressible foam tape with adhesive on both sides thereof providing adhesion between the rear surface of the low frequency speaker driver and front facing surface of the rear casing.

The waterproof speaker system as recited herein may further comprise a volume of water impermeable sealant between the perimeter edge of the front frame and interior surface of the casing.

The waterproof speaker system as recited above may further comprise a volume of water impermeable sealant between the front face panel and the front frame.

The waterproof speaker system may be arranged wherein the rear casing is cast of Acrylonitrile Styrene Acrylate (ASA) Plastic.

A speaker mounting system is disclosed in one example comprising a speaker casing comprising a bracket attachment system comprising a plurality of bracket attachment points including:

- a landscape flat attachment point allowing the speaker casing to be mounted to a vertical surface where the front face panel of the speaker is substantially parallel to the vertical surface in a landscape orientation;
- a portrait flat attachment point allowing the speaker casing to be mounted to a vertical surface where the front face panel of the speaker is substantially parallel to the vertical surface in a portrait orientation;
- a landscape angled attachment point allowing the speaker casing to be mounted to a vertical surface where the front face panel of the speaker is at a substantial angle to the vertical surface in a landscape orientation;
- a portrait angled attachment point allowing the speaker casing to be mounted to a vertical surface where the front face panel of the speaker is at a substantial angle to the vertical surface in a portrait orientation.

A rigid bracket is also disclosed which may be removably attached to the speaker casing at one of the bracket attachment points. The bracket comprising one or more attachment locations where the speaker casing may be mounted to or rest upon a support structure.

The speaker mounting system as recited herein may be arranged wherein the landscape flat attachment point allows the speaker casing to rest upon to a horizontal surface in a landscape orientation without attachment to the horizontal surface; and the portrait flat attachment point allows the speaker casing to rest upon to a horizontal surface in a portrait orientation without attachment to the horizontal surface.

DESCRIPTION OF THE PREFERRED EMBODIMENTS

Disclosed herein is a waterproof speaker system for use in residential and commercial applications. The disclosed speaker system is particularly applicable to wet conditions such as found in greenhouses, gardens, boats, and other outdoor installations where traditional speakers are negatively affected by water and humidity.

Before continuing with the detailed description, an axes system 10 is disclosed in the Figs. generally comprising a long axis 12 and a transverse axis 14. A short axis 16 is also disclosed. These axes are intended to aid in description of the disclosure and are not intended to be read into limitations of the claims. The speaker system can be oriented in generally any direction and still function as required.

Figure 1:
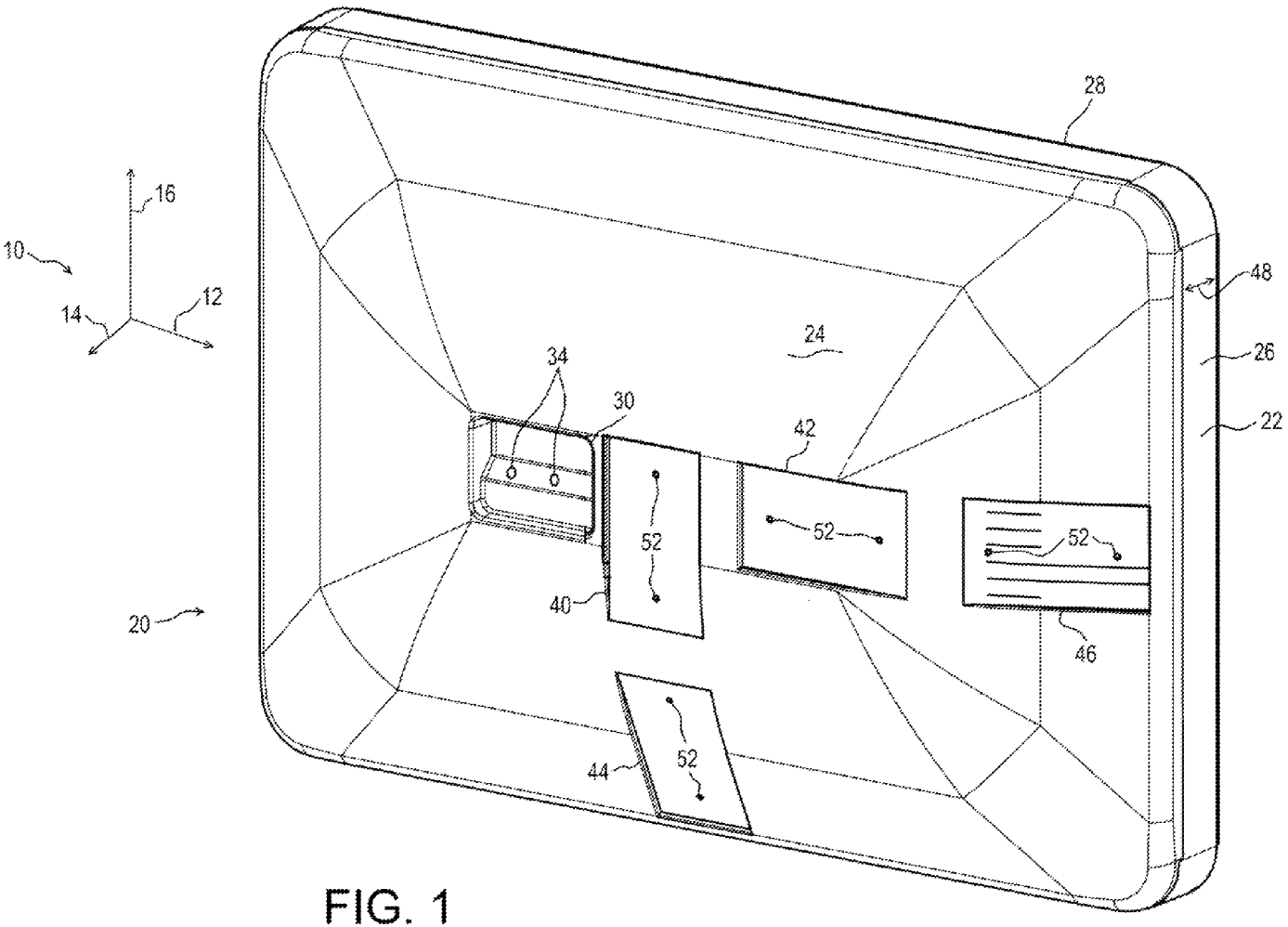
FIG. 1 is a rear isometric view of one example of the disclosure.
Figure 7:
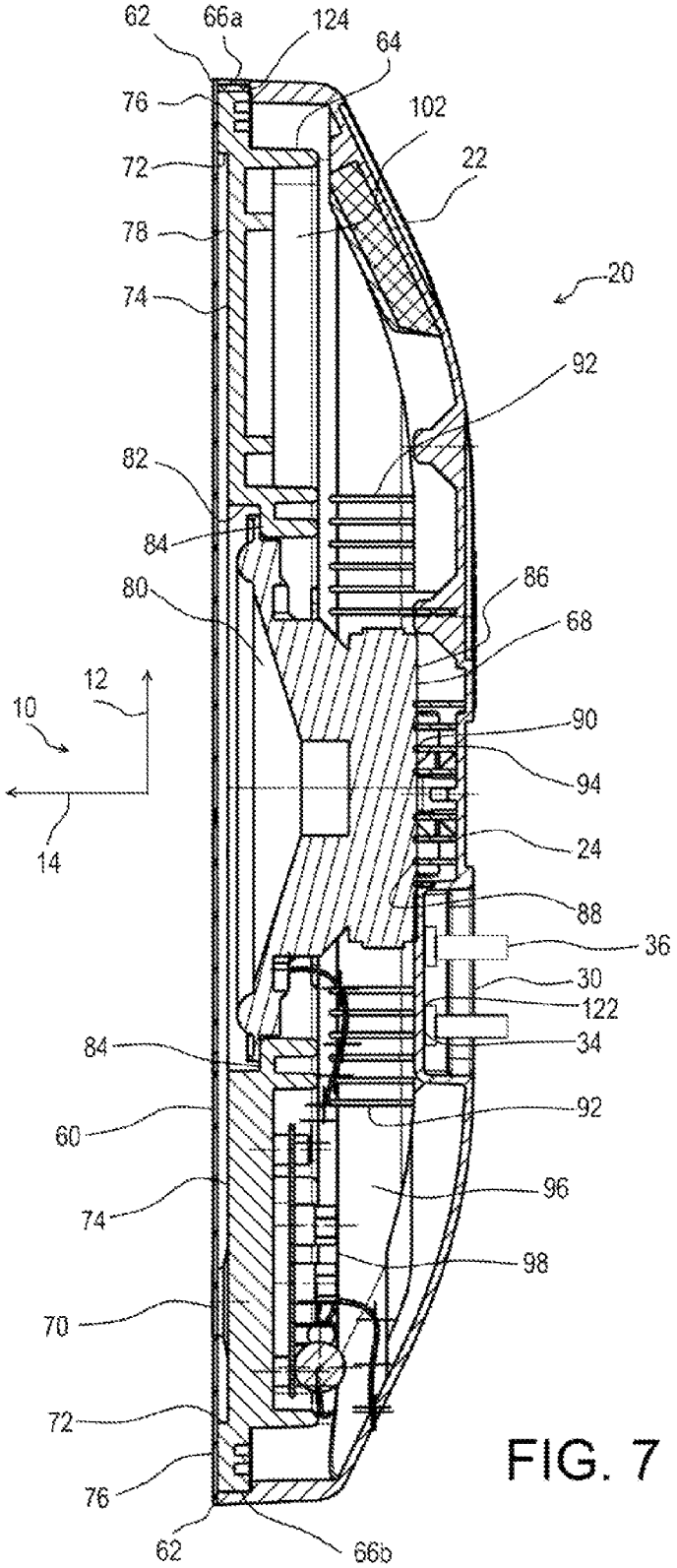
FIG. 7 is a top cutaway view of the example shown in FIG. 2.
Figure 11:
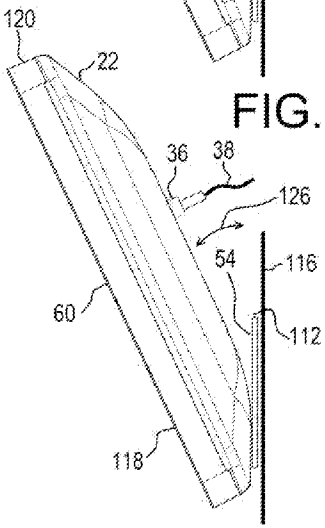
FIG. 11 is a side parallel view of the example shown in FIG. 1 in a portrait angled mounted position.

Looking to FIG. 1, the waterproof speaker system 20 is shown from the back side thereof. The rear casing 22 of the system 20 can be clearly seen including a rear surface 24 and outer edges 26/28. Also shown is a wiring recess 30 which is provided with a plurality of stud voids 34. Upon complete assembly, studs 36 as shown in FIGS. 7 and 11 are mounted into the stud voids 34 to allow for easy attachment of wires 38 (FIG. 11) providing electrical communication from a stereo or other audiovisual equipment to the speaker drivers within the casing 22. An O-ring 122 may be pressed between each stud 36 and the casing 22 to seal the stud void 34 and prohibit water entry.

Figures 8, 9:
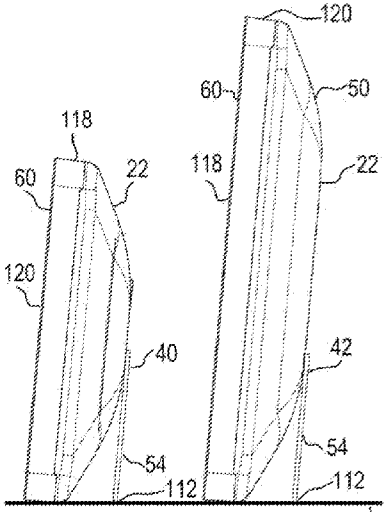
FIG. 8 is a side parallel view of the example shown in FIG. 1 in a landscape standing position.
FIG. 9 is a side parallel view of the example shown in FIG. 1 in a portrait standing position.

While the rear casing 22 can be provided in many different shapes and/or sizes the design provided herein facilitates a shallow depth 48 at the perimeter edge. A substantially rounded back portion 50 shown in FIG. 9 provides an aesthetically pleasing assembly with a low visual impact.

In one form, the rear casing 22 is formed of a polymer cast as a unitary body. Testing has shown that a rear casing 22 cast of Acrylonitrile Styrene Acrylate (ASA) Plastic provides a sufficiently rigid structure with high ultraviolet protection providing a long-lasting housing while not negatively affecting the audio characteristics thereof.

Looking back to FIG. 1, several bracket attachment points are shown for attachment of the example bracket 54 including: a landscape flat attachment point 40; a portrait flat attachment point 42; a landscape angled attachment point 44; and a portrait angled attachment point 46. These attachment points will be described in more detail below. While a plurality of holes 52 are provided in each of the attachment points 40-46, generally these holes are blind (not through casing 22) and do not provide a fluid conduit into the interior portion of the casing 22. Looking to FIG. 14, it can be seen how the example bracket 54 may be provided with mounting holes 56 through which fasteners such as screws, rivets, or other fasteners may pass and be received by the holes 52. In addition, T-slots 58 may be provided in the bracket 54 through which fasteners pass when the speaker system 20 is mounted in the orientations shown in FIGS. 10-13.

Figure 2:
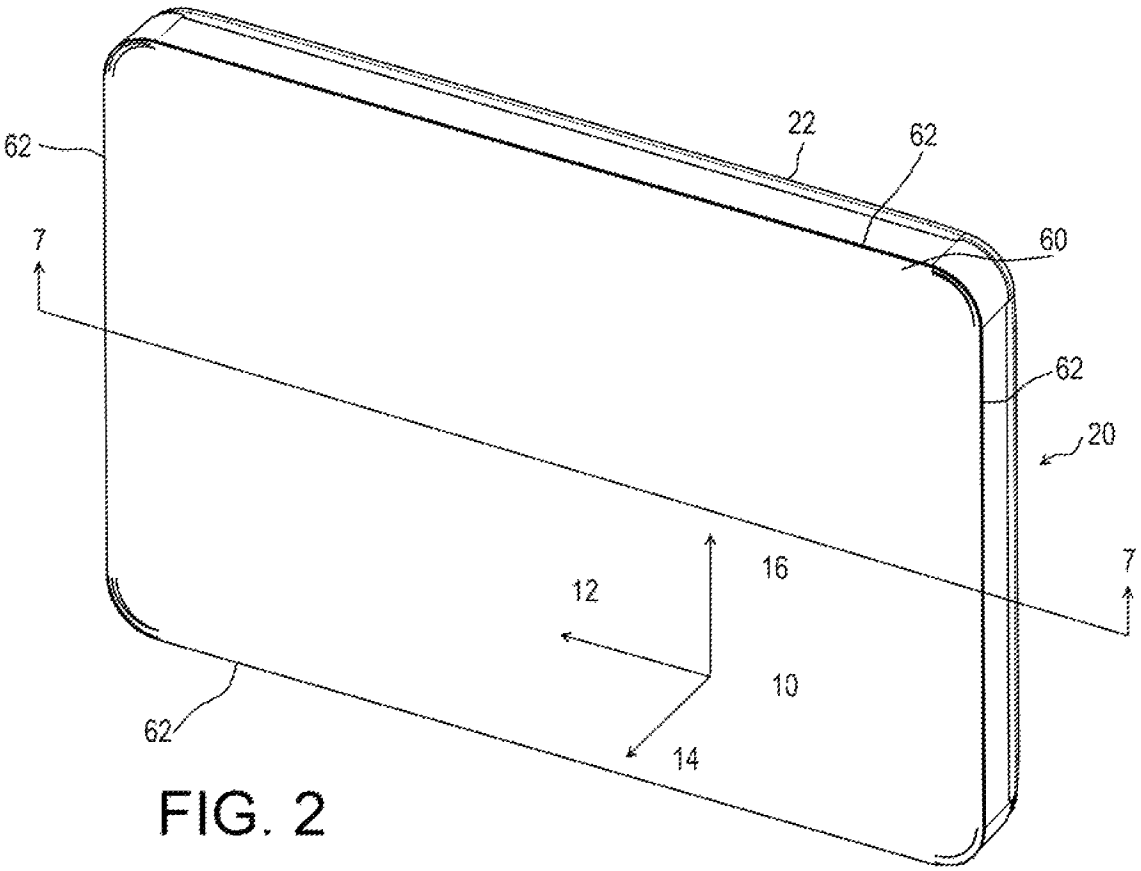
FIG. 2 is a front isometric view of the example shown in FIG. 1.
Figure 3:
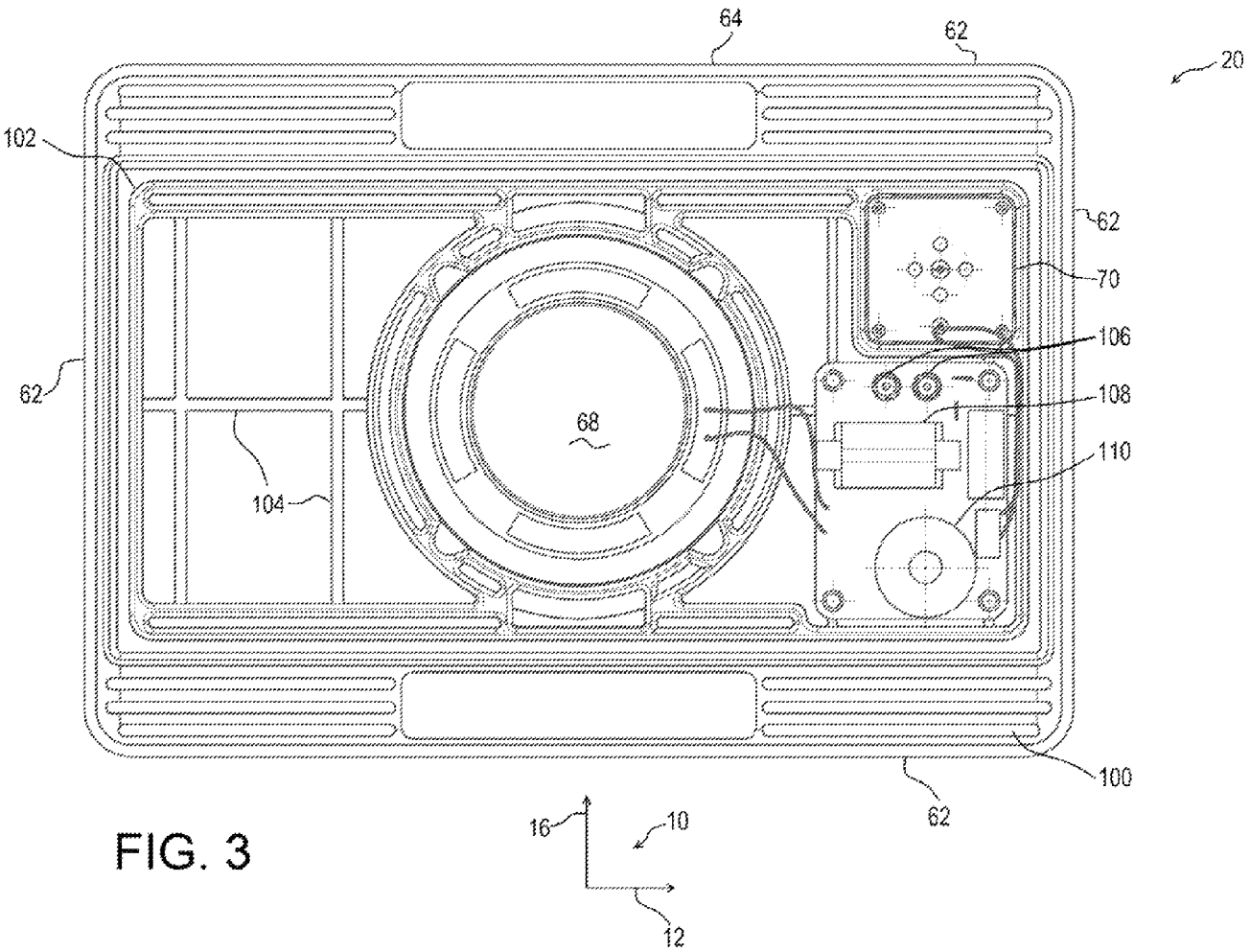
FIG. 3 is a rear parallel view of the internal components of the example shown in FIG. 1.

Looking to FIG. 2, it can be seen that the waterproof speaker assembly 20 may include a front face panel 60 which covers the front portion of the waterproof speaker assembly 20 and in this example generally extends to the outer edges 62 of the casing 22. While many different materials can be utilized for the front face panel 60 including extruded polystyrene, foam core, other polymers, organic sheet goods, etc., testing has shown that a layer of fiberglass or carbon fiber set in resin or similar hardening agent forms a water impermeable surface with exceptional acoustic qualities and resistance to sunlight and small impacts often encountered in the environments into which the speaker assemblies will be utilized. A layer of gelcoat may be used to provide a high quality finish on the visible surface of the fiber-reinforced composite material and to provide additional water impermeability and UV protection.

Looking to FIG. 7, a cross-sectional view of the waterproof speaker system 20 is shown as taken along line 7-7 of FIG. 2. This Fig. clearly shows the rear casing 22 encapsulating the rear portion of the speaker system 20 and in this example generally the edges of the casing 22 contact the outer edges 62 of the front face panel 60.

A frame 64 is placed into the casing 22 and extends in the long direction 12 from a perimeter edge 66*a* to a perimeter edge 66*b* on the opposing long side. In one form, the frame 64 is sealed to the interior perimeter surface of the rear casing 22 at this perimeter edge. In one form, a volume of silicone sealant 124 is utilized which cures to a malleable state to maintain a waterproof seal. This design and assembly effectively creates a waterproof enclosure for the speaker drivers 68 and 70. While previous "waterproof" speakers have been attempted in the past, normally the front face of such a prior speaker driver is exposed to water, and only the wiring and electronics regions are truly sealed. This allows for deterioration of the speaker driving surface itself.

In one example, one driver 68 is a low-frequency element or "woofer", while another speaker driver 70 is a high-frequency element or "tweeter". Other speaker drivers or combinations of drivers may be utilized including a single or plural driver for a wide range of acoustic capabilities, or alternatively a single speaker driver mounted within a housing which may interoperate with nearby speaker systems having speaker drivers of alternate acoustical ranges. For example, a "woofer" may be provided in a first casing, while a "tweeter" may be used in an adjacent casing.

As can be seen in the cross-sectional view of FIG. 7, an offset edge 72 is provided extending forward from an inner front face 74 of the frame 64. The offset edge 72 is inward from the perimeter edge 66 to allow the inner face of the front face panel 62 to be coupled at 76 to the frame 64 while maintaining an offset void 78 between the front face panel 60 and the front face 74 of the frame 64. The driving surface 80 of the driver 68 will oscillate and create a pressure wave within the offset void 78 causing the front face panel 62 oscillate and function as a face of the speaker driver. Generally, this is known as an acoustic lever described in U.S. Pat. No. 7,292,702 incorporated herein by reference. In the example shown, the other speaker driver 70 may be in contact with or even attached to the inner face of the front face panel 60 to directly oscillate the front face panel at different operating frequencies.

In this example, the frame 64 comprises a surface defining a driver void 82 through the frame 64, and a shelf 84 to which the driver 68 is mounted. The driver may be mounted (attached) by way of adhesive, fasteners, or similar methods. In addition, to provide a waterproof speaker system 20 with a relatively thin profile and rugged construction, the rear surface 86 of the driver 68 may be in contact with the inner forward facing surface 88 of the casing 22. In some experiments, it has been found that such contact resulted in intermittent vibration between the surfaces as the driver 68 oscillated. To counter this vibration to improve durability and function, a resilient member 90 may be provided between the rear surface 86 of the driver 68 and the inner front surface 88 of the casing 22.

A volume of silicone adhesive or many similar resilient adhesive materials may be utilized, including non-fluid resilient materials such as rubber, Sorbothane, etc., with or without adhesive, one example product has been found comprising a rubber like material in tape form with a strong adhesive on the front and rear faces thereof. During assembly, a portion of this material is placed between the rear surface 86 of the driver 68 and the inner forward facing surface 88 of the rear casing 22 and pressed there as the frame 64 is installed into the rear casing 22.

To increase rigidity of the rear casing 22, ridges 92 and 94 may be cast or otherwise provided. While the cutaway view shows the use in one orientation, such ridges may also be provided bilaterally if desired. For example, ridges 92 are generally aligned with the short axis 16 while ridges 96 are generally aligned with the long axis 12.

In the example shown in FIG. 7, the resilient material 90 is provided on the inner front surface 88 of the ridges 94 providing an exemplary support for the driver 68.

Figure 4:
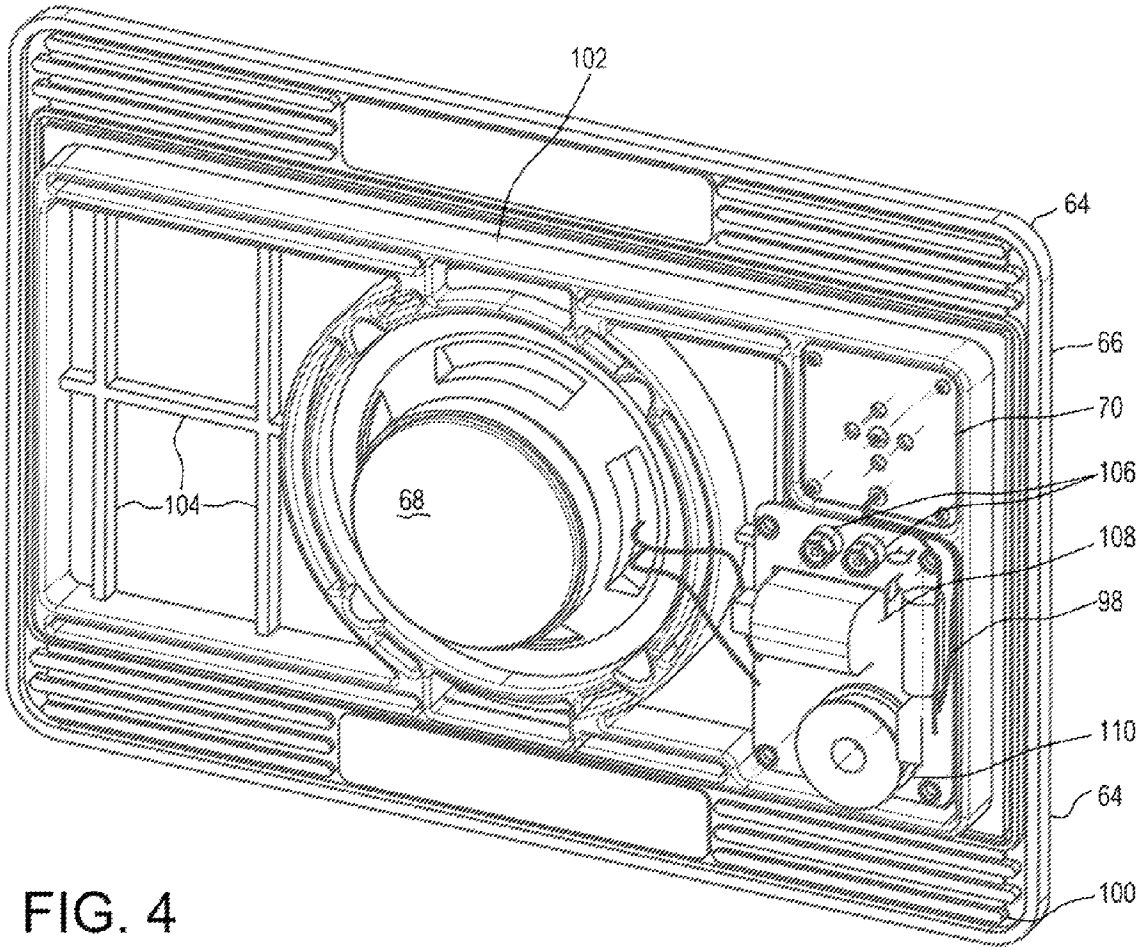
FIG. 4 is a rear isometric view of the example shown in FIG. 3.
Figure 5:
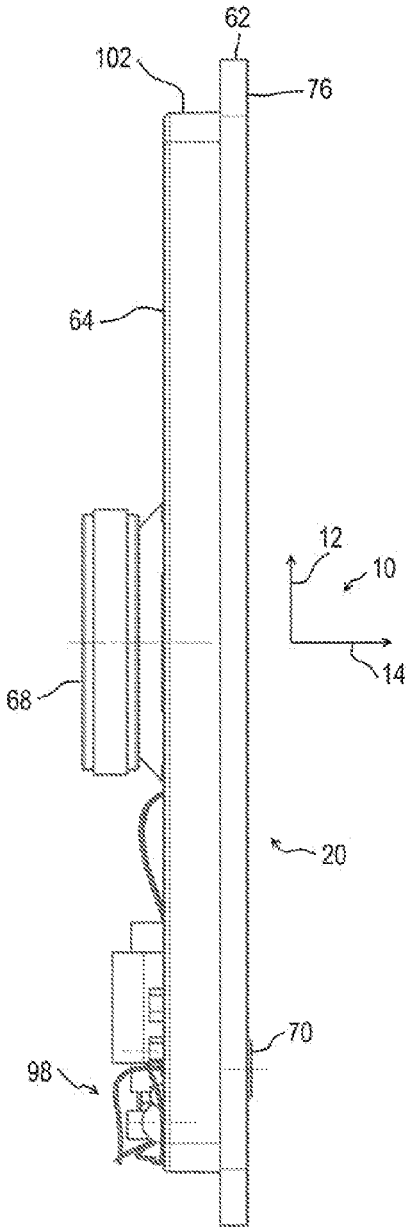
FIG. 5 is a side parallel view of the example shown in FIG. 3.
Figure 6:
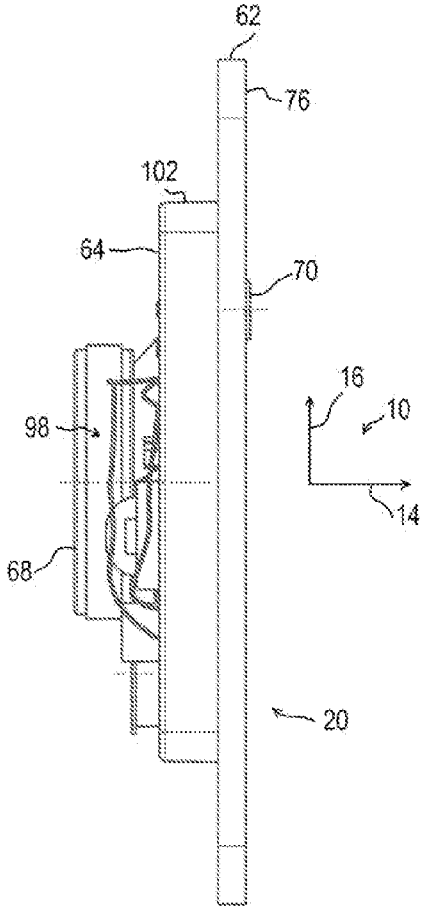
FIG. 6 is a top parallel view of the example shown in FIG. 3.

Looking to FIG. 4 the rear surface of the frame 64 is shown. In this example, the frame 64 is also cast as a unitary body to which the driver 68, high-frequency element 70, and control package 98 are attached. As with the casing 22, the frame 64 may comprise ridges 100, 102, and/or 104 for rigidity and structural integrity.

The control package 98 in one form may be coupled to the external studs 36 (FIG. 11) through internal studs 106. In one form, the control package 98 comprises a transformer 108 and coil 110 to manipulate the acoustic signal received at the internal studs 106 which in turn actuates the drivers 68 and 70.

One example of a speaker mounting system is also disclosed. In this disclosure, the term "portrait" will be used to define an orientation where the long side 118 (FIG. 8) of the casing 22 is generally vertical, and the short side 120 (FIG. 9) is generally horizontal. The term "landscape" will be used to define an orientation where the long side 118 of the casing 22 is generally horizontal, and the short side 120 is generally vertical. As previously mentioned, the mounting system as shown in FIGS. 8-14 may include several attachment points for the bracket 54. The attachment locations 40-46 are shown best in FIG. 1, while the bracket 54 is best shown in FIG. 14.

This mounting system allows attachment of the bracket 54 in several different positions on the casing 22 so that the speaker system 20 may be mounted or free-standing in several different orientations.

In one form as shown in FIG. 8, the bracket 54 is attached at the landscape flat attachment point 40 and the distal end 112 of the bracket 54 rests upon a horizontal surface 114 in a landscape orientation without attachment to the horizontal surface.

In one form as shown in FIG. 9, the bracket 54 is attached at the portrait flat attachment point 42 and the distal end 112 of the bracket 54 rests upon the horizontal surface 114 in a portrait orientation without attachment to the horizontal surface.

Figure 10:
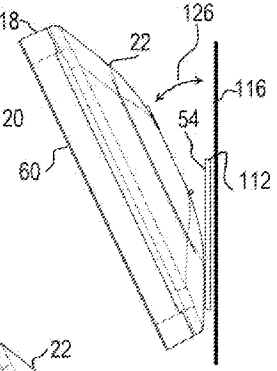
FIG. 10 is a side parallel view of the example shown in FIG. 1 in a landscape angled mounted position.

FIG. 10 shows that in one example the landscape flat attachment point 44 allows the speaker casing 22 to be mounted to a vertical surface 116 where the front face panel 60 of the speaker system 20 is at a substantial angle 126 to the vertical surface 116 in a landscape orientation. In one example, the t-slots 58 allow for removable attachment to the vertical surface 116. The bracket 54 may be bent, attached in other ways, or other adjustments may be made to alter the angle 126.

FIG. 11 shows that in one example the portrait flat attachment point 42 allows the speaker casing 22 to be mounted to a vertical surface 116 where the front face panel 60 of the speaker system 20 is at a substantial angle 126 to the vertical surface 116 in a portrait orientation. In one example, the t-slots 58 allow for removable attachment to the vertical surface 116. Again, the bracket 54 may be bent, attached in other ways, or other adjustments may be made to alter the angle 126.

Figure 12:
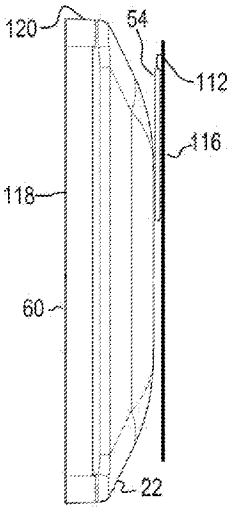
FIG. 12 is a side parallel view of the example shown in FIG. 1 in a portrait flat mounted position.

FIG. 12 shows that in one example, the portrait flat attachment point 42 allows the speaker casing 22 to be mounted to a vertical surface 116 where the front face panel 22 of the speaker system 20 is substantially parallel to the vertical surface 116 in a portrait orientation. The bracket 54 may also comprise a hook or other structure to form a suspension point to "hang" the speaker system from a bar or other support structure.

Figure 13:
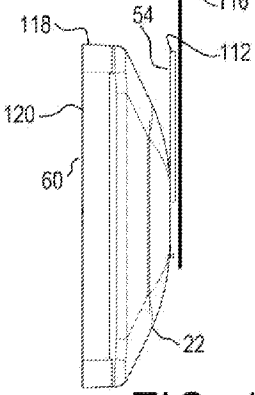
FIG. 13 is a side parallel view of the example shown in FIG. 1 in a landscape flat mounted position.
Figure 14:
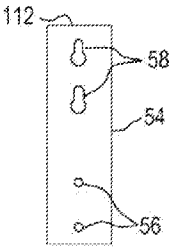
FIG. 14 is a front view of one example of a rigid bracket such as shown in FIGS. 8-13

FIG. 13 shows that in one example, the landscape flat attachment point 40 allows the speaker casing 22 to be mounted to a vertical surface 116 where the front face panel 22 of the speaker system 20 is substantially parallel to the vertical surface 116 in a landscape orientation.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and method Komatex and illustrative examples shown and described. Accordingly, departures may be made from such details without departing from the spirit or scope of applicants' general concept.

Therefore I claim:

1. A waterproof speaker system comprising:

a water impermeable rear casing cast as a unitary body with a rear panel and with side panels substantially orthogonal to the rear panel;

a front frame cast as a unitary body, the front frame having a perimeter edge sealed to the side panels of the rear casing;

a water impermeable front face panel sealed to a perimeter face of the front frame and substantially in contact with the rear casing;

the front frame having a surface defining a driver void therethrough having substantially the same shape as the perimeter edge of a low frequency speaker driver;

wherein the perimeter edge of the low frequency speaker driver is attached to the surface defining the driver void such that the low frequency speaker driver is not in contact with the front face panel;

wherein a rear surface of the front face panel, front surface of the front frame, front surface of the low frequency speaker driver and offset edge define an offset void allowing the front face panel to oscillate without contacting the front surface of the front frame nor low frequency speaker driver; and a speaker wiring stud sealed to and projecting through the rear casing to provide electrical communication to the low frequency speaker driver.

2. The waterproof speaker system as recited in claim 1 further comprising a resilient member compressed between a rear surface of the low frequency speaker driver and a front facing surface of the rear casing.

3. The waterproof speaker system as recited in claim 2 wherein the resilient member is adhered to one or both of the rear surface of the low frequency speaker driver and front facing surface of the rear casing.

4. The waterproof speaker system as recited in claim 3 comprising a compressible foam tape with adhesive on both sides thereof providing adhesion to both the rear surface of the low frequency speaker driver and front facing surface of the rear casing.

5. The waterproof speaker system as recited in claim 1 further comprising a volume of water impermeable sealant between the perimeter edge of the front frame and interior surface of the rear casing.

6. The waterproof speaker system as recited in claim 1 further comprising a volume of water impermeable sealant between the front face panel and the front frame.

7. The waterproof speaker system as recited in claim 1 wherein the rear casing is cast of Acrylonitrile Styrene Acrylate (ASA) Plastic.

8. The waterproof speaker system as recited in claim 1 further comprising:

the rear casing with a bracket attachment system having a plurality of bracket attachment points including:

a landscape flat attachment point allowing the rear casing to be mounted to a vertical surface where the front face panel is substantially parallel to the vertical surface in a landscape orientation;

a portrait flat attachment point allowing the rear casing to be mounted to a vertical surface where the front face panel is substantially parallel to the vertical surface in a portrait orientation;

a landscape angled attachment point allowing the rear casing to be mounted to a vertical surface where the front face panel is at a substantial angle to the vertical surface in a landscape orientation;

a portrait angled attachment point allowing the rear casing to be mounted to a vertical surface where the front face panel is at a substantial angle to the vertical surface in a portrait orientation; and a rigid bracket removably attached to the rear casing at one of the bracket attachment points and comprising attachment locations where the rear casing may be mounted to a support structure.

9. The waterproof speaker mounting system as recited in claim 8 wherein:

the landscape flat attachment point allows the rear casing to rest upon a horizontal surface in a landscape orientation without attachment to the horizontal surface; and the portrait flat attachment point allows the rear casing to rest upon a horizontal surface in a portrait orientation without attachment to the horizontal surface.

* * * * *